US005174363A

United States Patent [19]

Furo et al.

[11] Patent Number: 5,174,363

[45] Date of Patent: Dec. 29, 1992

[54] PROCESS FOR PRODUCING SHAPE STRIPS OF METALS

[75] Inventors: Masahiro Furo; Hitoshi Endou; Tadao Hishinuma, all of Tokyo, Japan

[73] Assignee: Dowa Mining Co., Ltd., Tokyo, Japan

[21] Appl. No.: 689,152

[22] Filed: Apr. 22, 1991

[30] Foreign Application Priority Data

Oct. 4, 1990 [JP] Japan ..... 2-267022

[51] Int. Cl.[5] ..... B21B 1/46; B22D 11/12

[52] U.S. Cl. ..... 164/476; 72/252.5; 72/366.2

[58] Field of Search ..... 164/476; 72/252.5, 366.2

[56] References Cited

U.S. PATENT DOCUMENTS 4,515,204 5/1985 Ohno ..... 164/483

FOREIGN PATENT DOCUMENTS

| | | | |
|---|---|---|---|
| 52-908 | 1/1977 | Japan . | |
| 56-117803 | 9/1981 | Japan | 72/366.2 |
| 57-70002 | 4/1982 | Japan | 72/366.2 |
| 60-64703 | 4/1985 | Japan | 72/366.2 |
| 62-227502 | 10/1987 | Japan | 72/252.5 |
| 1-30563 | 6/1989 | Japan . | |
| WO87/05543 | 9/1987 | PCT Int'l Appl. | 72/252.5 |

*Primary Examiner*—J. Reed Batten, Jr.

*Attorney, Agent, or Firm*—Frishauf, Holtz, Goodman & Woodward

[57] ABSTRACT

Molten metal is poured into a mold having an inside cross section with varied thicknesses along the direction of the width thereof. The molten metal is allowed to solidify in the mold and the cast strip is withdrawn from the mold either continuously or intermittently. The as-cast strip is rolled at either identical or similar thickness reduction ratios in the direction of width of the strip. This process enables the production of high quality shape strips free from any substantial working deformation in the workpiece.

3 Claims, 1 Drawing Sheet

PROCESS FOR PRODUCING SHAPE STRIPS OF METALS

BACKGROUND OF THE INVENTION

The present invention relates to a process for producing shape strips of metals that are suitable for use as materials for high-grade terminal leads and lead frames, etc.

The term "shape strips" herein used means a long piece of solid material whose longitudinal dimension is much larger than its cross-sectional dimension having different thicknesses in the direction of width, and includes bars, rods, sheets, plates or the like having profiled cross section whose thickness varies in the direction of width. One of the representative examples of such shape strips is shown by its cross-section in FIG. 2 with the reference number 7.

Prior art techniques that have been proposed and practiced for producing shape strips of metals include the method of using a V-shaped die and flat surfaced rollers and the method of rolling by means of the combined use of a grooved roll and a flat roll. The first method is described in Japanese Patent Publication No. 908/1977 and comprises the steps of placing a flat workpiece in a receiving mold having a groove in the inner surface and deforming the flat workpiece in the direction of width by rotating flat rollers installed on the opposite side of said receiving mold in a direction that crosses the longitudinal direction of the workpiece. The second method is described in Japanese Patent Publication No. 30563/1989 and is characterized by using work rolls at least one of which is grooved. In this method, a workpiece is rolled with the rolling force being applied only to the area where the thickness of the workpiece should be reduced in the direction of width so that the part of the workpiece positioned in the groove in the grooved roll will deform by buckling, and the buckling part is subsequently flattened with the flat roll.

In these and other prior art methods, a flat workpiece is worked into various shapes, so the reduction ratio varies in areas having different thicknesses and there is a working limit as regards the thickness ratio between thin and thick portions of the strip. Because of these problems, the prior art methods have had the following defects:

1) the working operations are cumbersome and inevitably require large equipment;
2) because of the difference in thickness reduction ratio (draft) in areas having different thicknesses, structural differences tend to remain even after annealing and such structural differences will cause residual strain;
3) it is difficult to produce shape strips of a complex profile such as one having two or more ridges; and
4) high production rate is difficult to achieve.

The present invention has been achieved under these circumstances aiming at developing a new process by which a shape strip of high quality that is finished to have a desired cross sectional profile can be produced without causing any substantial working deformation in the workpiece.

SUMMARY OF THE INVENTION

The present inventors conducted intensive studies in order to solve the aforementioned problems of the prior art and found that the object of the present invention could be attained by a process comprising the steps of pouring a molten metal into a mold having an inside cross section with varying thickness in the direction of the width thereof, allowing the melt to solidify in the mold, withdrawing the cast shape strip from the mold either continuously or intermittently, and rolling the as-cast shape strip at either identical or similar reduction ratios with respect to the thickness in the direction of the width thereof.

DETAILED DESCRIPTION OF THE INVENTION

According to the present invention, a molten metal is first poured into a mold having an inside cross section with varying thickness in the direction of width and, after the melt solidifies in the mold, the resulting cast shape strip is withdrawn either continuously or intermittently and immediately rolled at either identical or similar reduction ratios (the term "similar" shall be used hereinafter to cover both cases) with respect to the thickness in the direction of width. If necessary, the rolled shape strip may be subjected to repeated annealing and rolling at similar reduction ratios.

Stated more specifically, a mold the inside cross section of which has varied thicknesses in the direction of width is positioned beneath a melt holding furnace, the thickness ratio between the varied thicknesses in said inside cross section being similar to the thickness ratio between varied thicknesses in the final desired profile. A molten metal is poured into the mold, which is then cooled with a water-cooling jacket to have the melt solidify within the mold. By subsequent withdrawing either continuously or intermittently, a strip having a thickness ratio similarity to the final desired profile in the meaning mentioned above can be easily obtained.

The strip is then passed between two rolls one of which is grooved and rolling is performed in such a way as to achieve similar reduction ratios in thin and thick portions of the strip, whereby a shape strip having neither torsion nor uneven elongation can be obtained. This strip is subsequently annealed under conditions that will fully eliminate the structure affected by casting and thereafter it is subjected to another cycle of rolling at similar reduction ratios. By such annealing and rolling steps conducted for tempering purposes, a shape strip of homogeneous quality can be produced that has no differences in hardness and structure between thin and thick portions.

Further, the present invention enables a strip to be cast in such a way that it will have a similar thickness ratio in the direction of width to the desired final cross section. Since subsequent rolling is performed at similar reduction ratios in thin and thick portions, the working strain that develops in the strip will become uniform. Hence, shape strips that are suitable for use as materials for high-grade terminal leads and lead frames can be produced by the present invention.

Shape strips of various kinds of metals can be produced by the process of the present invention providing that the metal is castable from its melt. Representative examples of metals which can be cast and rolled into shape strips according to the present invention include copper, iron, lead, zinc, gold, silver, aluminum, and alloys mainly comprising any one or two or more of the above-mentioned metals, with copper and its alloys being most important.

The process of the present invention is described below in greater detail with reference to a working example.

EXAMPLE

Figure 1:
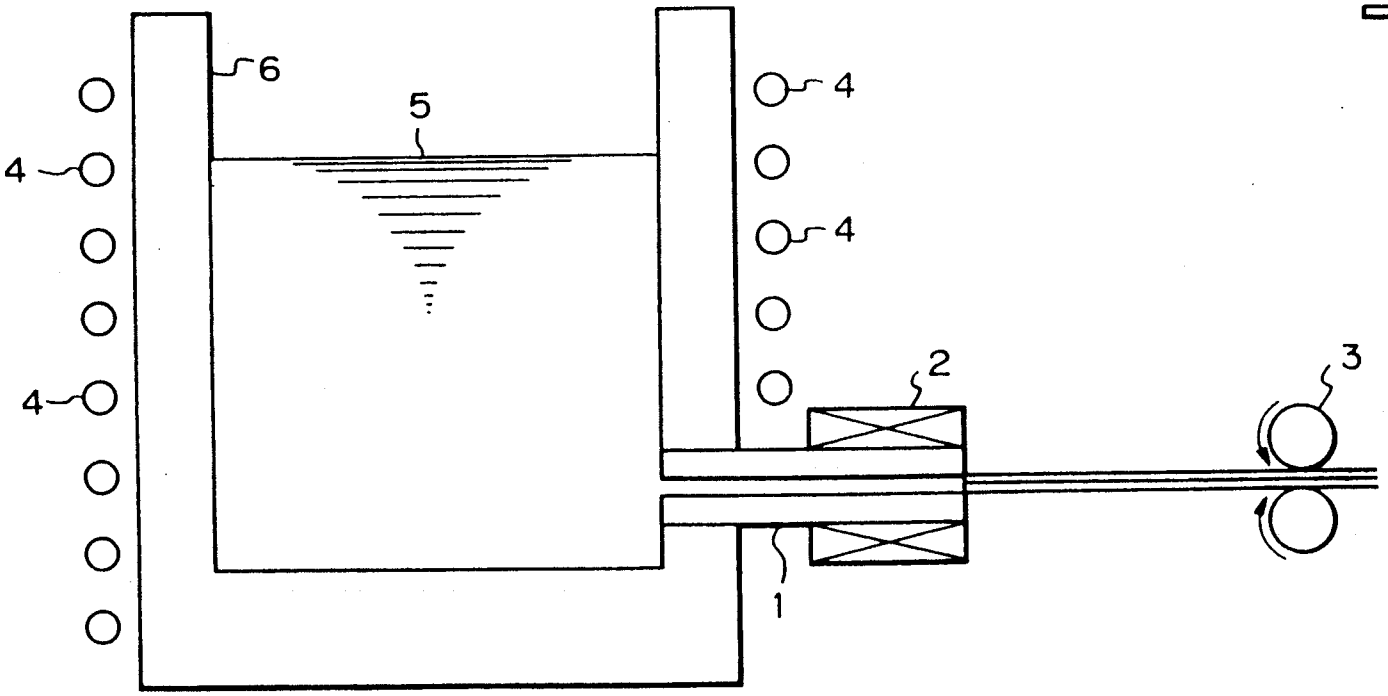
FIG. 1 is a schematic diagram showing how a strip is cast in the process of the present invention.

As shown in FIG. 1, a graphite mold 1 having a hollow space that resembled in cross section to the final shape strip (80 mm wide, 2 mm thick in thin portions, and 7 mm thick in the ridge portion) was attached to a melting crucible 6. A heater 4 was provided so that a molten metal 5 in the crucible 6 would be held at a predetermined temperature. The mold 1 was adapted to be cooled with a copper water-cooling jacket 2.

Figure 2:
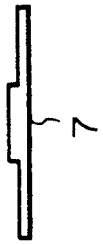
FIG. 2 is a cross section showing a strip as withdrawn from the mold in the apparatus shown in FIG. 1.

A copper dummy bar (not shown) whose cross section is the same as the inside cross section of the mold 1 was placed in the latter and a molten metal 5 was poured into the crucible 6. The molten metal in the mold 1 was withdrawn intermittently by means of pinch rolls 3 at a rate of 150 mm/min, whereby a shape strip 7 having thick and thin portions of the same thickness ratio as the desired strip (see FIG. 2) was obtained.

The shape strip 7 was passed between two work rolls (not shown) one of which was grooved and rolling was performed at the same reduction ratio in accordance with the predetermined thickness ratio in the direction of width and the rolled strip was subsequently annealed by heating at 500° C. for 1 h. By two cycles of such rolling and annealing procedures, a shape strip having the desired final profile (FIG. 2) could be easily obtained.

As described, the present invention is capable of producing shape strips by a simpler process than in the prior art since a strip having a cross section very close to the final profile can be directly obtained by casting. Further, the rolling as a post-treatment is performed at either the same or similar reduction ratios, so a shape strip of homogeneous and good quality can be produced by very simple procedures.

What is claimed is:

1. A process for producing a shape strip of a metal which comprises the steps of:

pouring a molten metal into a mold having an inside cross section with varying thickness in the direction of the width thereof, allowing the molten metal to solidify in the mold into a cast strip, withdrawing the cast strip from the mold either continuously or intermittently, and rolling the cast strip at either identical or similar reduction ratios with respect to the thickness in the direction of the width of the strip.

2. The process according to claim 1 wherein said metal is selected from the group consisting of copper, iron, lead, zinc, gold, silver, aluminum, and alloys mainly comprising any one or two or more of the above-mentioned metals.

3. The process according to claim 2 wherein said metal is copper or an alloy thereof.

* * * * *